US006366185B1

(12) United States Patent
Keesey et al.

(10) Patent No.: US 6,366,185 B1
(45) Date of Patent: Apr. 2, 2002

(54) VERTICAL INTERCONNECT BETWEEN COAXIAL OR GCPW CIRCUITS AND AIRLINE VIA COMPRESSIBLE CENTER CONDUCTORS

(75) Inventors: Timothy D. Keesey, Huntington Beach; Clifton Quan, Arcadia; Douglas A. Hubbard, West Hills; David E. Roberts, San Pedro; Chris E. Schutzenberger, Long Beach; Raymond C. Tugwell, Simi Valley; Gerald A. Cox, Playa Del Rey, all of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/482,188

(22) Filed: Jan. 12, 2000

(51) Int. Cl.[7] ..... H01P 3/08; H01P 1/00
(52) U.S. Cl. ..... 333/260; 333/246
(58) Field of Search ..... 333/260, 33, 246

(56) References Cited

U.S. PATENT DOCUMENTS

| | | | | |
|---|---|---|---|---|
| 4,383,226 A | | 5/1983 | Nygren | |
| 5,308,250 A | | 5/1994 | Walz | |
| 5,552,752 A | | 9/1996 | Sturdivant et al. | 333/243 |
| 5,618,205 A | | 4/1997 | Riddle | |
| 5,633,615 A | | 5/1997 | Quan | 333/33 |
| 5,668,509 A | | 9/1997 | Hoffmeister et al. | 333/33 |
| 5,675,302 A | | 10/1997 | Howard et al. | 333/243 |
| 5,689,216 A | | 11/1997 | Sturdivant | 333/33 |
| 5,703,599 A | | 12/1997 | Quan et al. | 342/368 |
| 5,886,590 A | * | 3/1999 | Quan et al. | 333/33 |

FOREIGN PATENT DOCUMENTS

| | | |
|---|---|---|
| EP | 0901181 A2 | 3/1999 |
| JP | 06125978 | 12/1995 |

* cited by examiner

*Primary Examiner*—Robert Pascal
*Assistant Examiner*—Kimberly E Glenn
(74) *Attorney, Agent, or Firm*—Leonard A. Alkov; Glenn H. Lenzen, Jr.

(57) ABSTRACT

An RF interconnect between an airline circuit including a dielectric substrate having a conductor trace formed on a first substrate surface and an RF circuit separated from the airline circuit by a separation distance. The RF interconnect includes a compressible conductor structure having an uncompressed length exceeding the separation distance, and a dielectric sleeve structure surrounding at least a portion of the uncompressed length of the compressible conductor structure. The RF interconnect structure is disposed between the substrate and the RF circuit such that the compressible conductor is placed under compression between the substrate and the RF circuit. Examples of the RF circuit include a vertical coaxial transmission line or a grounded coplanar waveguide circuit disposed in parallel with the airline circuit.

34 Claims, 6 Drawing Sheets

VERTICAL INTERCONNECT BETWEEN COAXIAL OR GCPW CIRCUITS AND AIRLINE VIA COMPRESSIBLE CENTER CONDUCTORS

TECHNICAL FIELD OF THE INVENTION

This invention relates to microwave devices, and more particularly to structures for interconnecting between coaxial transmission line and suspended air stripline.

BACKGROUND OF THE INVENTION

A typical technique for providing a vertical RF interconnect with a coaxial line uses hard pins. Hard pin interconnects do not allow for much variation in machine tolerance. Because hard pins rely on solder or epoxies to maintain electrical continuity, visual installation is required, resulting in more variability and less S-Parameter uniformity.

Another interconnect technique is a pin/socket type, blind mate interconnect. Pin/socket interconnects usually employ sockets which are much larger than the pin they are capturing. This size mismatch may induce reflected RF power in some packaging arrangements. For interconnects to airline, stripline or similar transmission lines, a pin would have to be soldered onto the surface of the circuit, causing more assembly and repair time.

SUMMARY OF THE INVENTION

An RF interconnect is described between an airline circuit including a dielectric substrate having a conductor trace formed on a first substrate surface and an RF circuit separated from the airline circuit by a separation distance. The RF interconnect includes a compressible conductor structure having an uncompressed length exceeding the separation distance, and a dielectric sleeve structure surrounding at least a portion of the uncompressed length of the compressible conductor structure. The RF interconnect structure is disposed between the substrate and the RF circuit such that the compressible conductor is placed under compression between the substrate and the RF circuit.

In one exemplary embodiment, the RF circuit is a coaxial transmission line including a coaxial center conductor, the center conductor extending transverse to the airline substrate. The compressible conductor is under compression between the coaxial center conductor and the substrate. In another embodiment, the RF circuit is a grounded coplanar waveguide (GCPW) circuit including a GCPW dielectric substrate with a first surface having a conductor center trace and a ground conductor pattern formed thereon, the compressible conductor under compression between the GCPW substrate and the airline substrate.

The compressible conductor can take many forms, including a bundle of densely packed thin wire, a bellows or a spring-loaded retractable probe structure. The compressible center conductor maintains a good physical contact without the use of solder or conductive epoxies.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

A vertical interconnect between suspended airline and a coaxial line in accordance with an aspect of the invention is made with a compressible center conductor, captured within a dielectric, such as REXOLITE™, TEFLON™, TPX™, and provides a robust, solderless vertical interconnect. The center conductor in an exemplary embodiment is a thin, gold plated, metal wire (usually tungsten or beryllium copper), which is wound up into a knitted, wire mesh cylinder. The compressible center conductor is captured within a dielectric in such a way as to form a coaxial transmission line.

Figure 1:
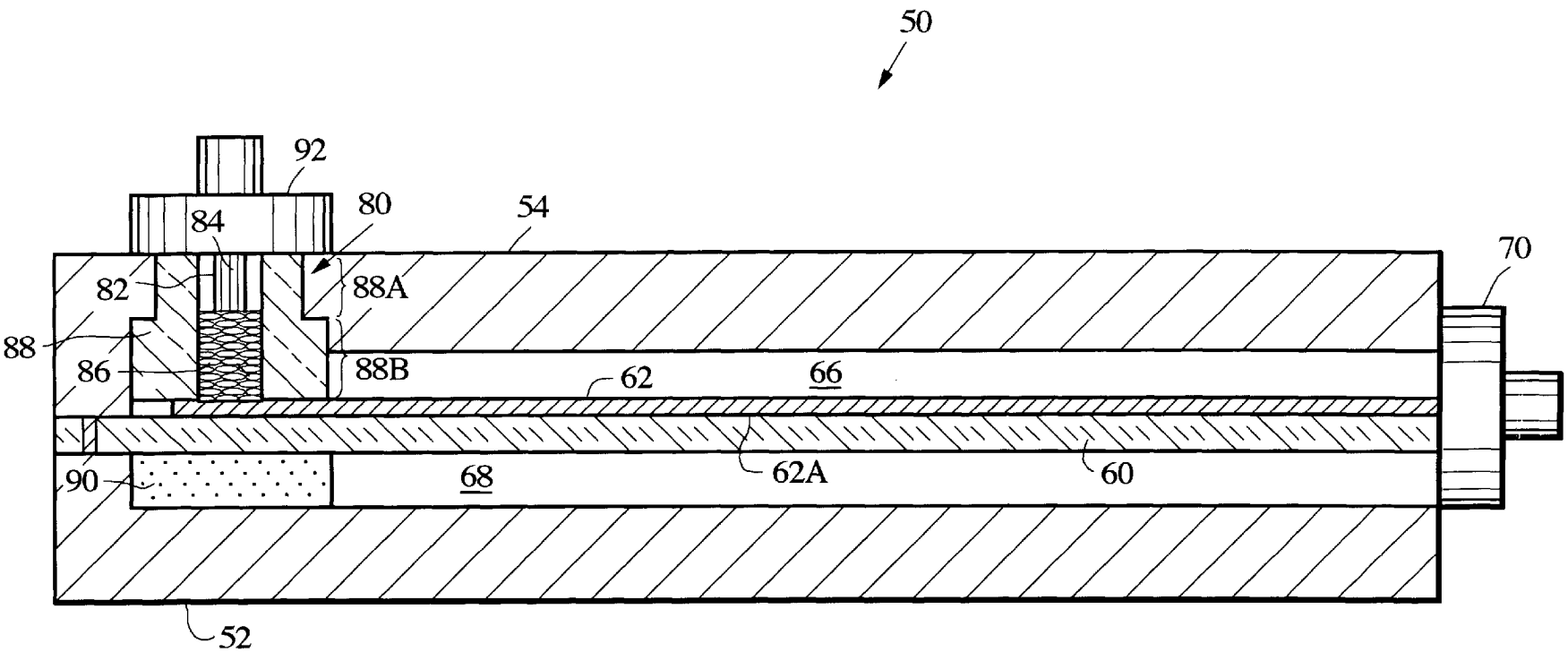
FIG. 1 is an unscaled side cross-sectional diagram of a first embodiment of an RF circuit device employing an airline-to-coaxial interconnect in accordance with the invention.

FIG. 1 is a cross-sectional diagram illustrating a first embodiment of the invention, illustrating an RF circuit 50 wherein a transition is made between a coaxial transmission line and an airline. This exemplary circuit includes an electrically conductive housing structure including a base plate 52 and a top plate structure 54. A dielectric substrate 60 is supported between the plates in a spaced relationship. An airline conductor layer strip 62 is fabricated on the top surface 62A of the dielectric substrate. It will be appreciated that the drawing figures are not to scale; for example, the thickness of the conductor strip 62 in relation to the substrate thickness is exaggerated for illustration purposes. Thus, an airline transmission line is formed by the dielectric substrate, the conductor layer strip, and the upper and lower housing plates, with air gaps 66 and 68 formed above and below the substrate.

A horizontal coaxial connector 70 is connected to the airline transmission line, although for many applications other circuits and connections can alternatively be integrated with or connected to the airline.

A vertical coaxial transmission line 80 extends transversely to the plane of the dielectric substrate 60, and includes a center conductor structure 82 which penetrates through an opening in the top plate to make contact with the airline conductor line. The center conductor structure includes a solid metal conductor pin 84 having a first diameter D1, which in this exemplary embodiment is 0.025 inch, and a compressible center conductor 86 having a second diameter D2 larger than D1. The pin 84 is surrounded by an air gap of 0.040 inch diameter. The coaxial transmission structure 80 further includes a dielectric sleeve structure 88 which encircles the center conductor structure. The sleeve structure has a first diameter in region 88A, and a second, larger diameter D4 in region 88B, with the smaller diameter region encircling the pin and the larger diameter region encircling the compressible conductor. The different diameters of the dielectric provide impedance matching to prevent mismatches due to the difference in sizes of the pin and compressible center conductor. The different diameters of the dielectric sleeve are accommodated by corresponding different diameters of the opening in the top plate 54, which form the outer conductor of the coaxial line through the top plate.

In accordance with an aspect of the invention, the airline circuit and the vertically oriented coaxial transmission line are separated in the vertical direction by a separation distance $D_S$, and the compressible conductor 86 has an uncompressed length slightly longer than the separation distance, so that the conductor 86 will be under compression when the RF interconnect is assembled.

The compressible center conductor 86 in this exemplary embodiment has an outer diameter of 0.040 inch. The dielectric sleeve 88 is fabricated of REXOLITE™, a moldable material with a dielectric constant of 2.5. The REXOLITE has an inner diameter of 0.040 inch, and an outer diameter of 0.069 inch in region 88A, and 0.157 inch in region 88B. The compressible center conductor 86 is inserted into the dielectric 88, forming a 50 ohm coaxial transmission line. The dielectric is captured within the metal structure of the top plate, which supplies the outer ground for the coaxial transmission line. When the dielectric structure is inserted into the top plate, it makes physical contact with the surface of the suspended airline. The compressible center conductor 86 makes electrical contact with the airline's center conductor 62 by direct physical contact with the airline's trace 62 on the top surface of the airline dielectric. The airline substrate is fabricated from a thin layer of dielectric, e.g. 0.005 inch thick CuClad 250. Because the CuClad 250 is relatively thin, a foam block 90 is placed underneath the interface area to prevent deflection of the airline. In one exemplary embodiment, an SMA connector 92 with 0.020 inch diameter protruding pin 82 is used to compress the compressible conductor 86 onto the airline. The airline is terminated in the SMA microstrip launch connector 70. Of course, in other embodiments, the airline and coaxial line may connect to other circuits or transmission line structures.

Figure 2:
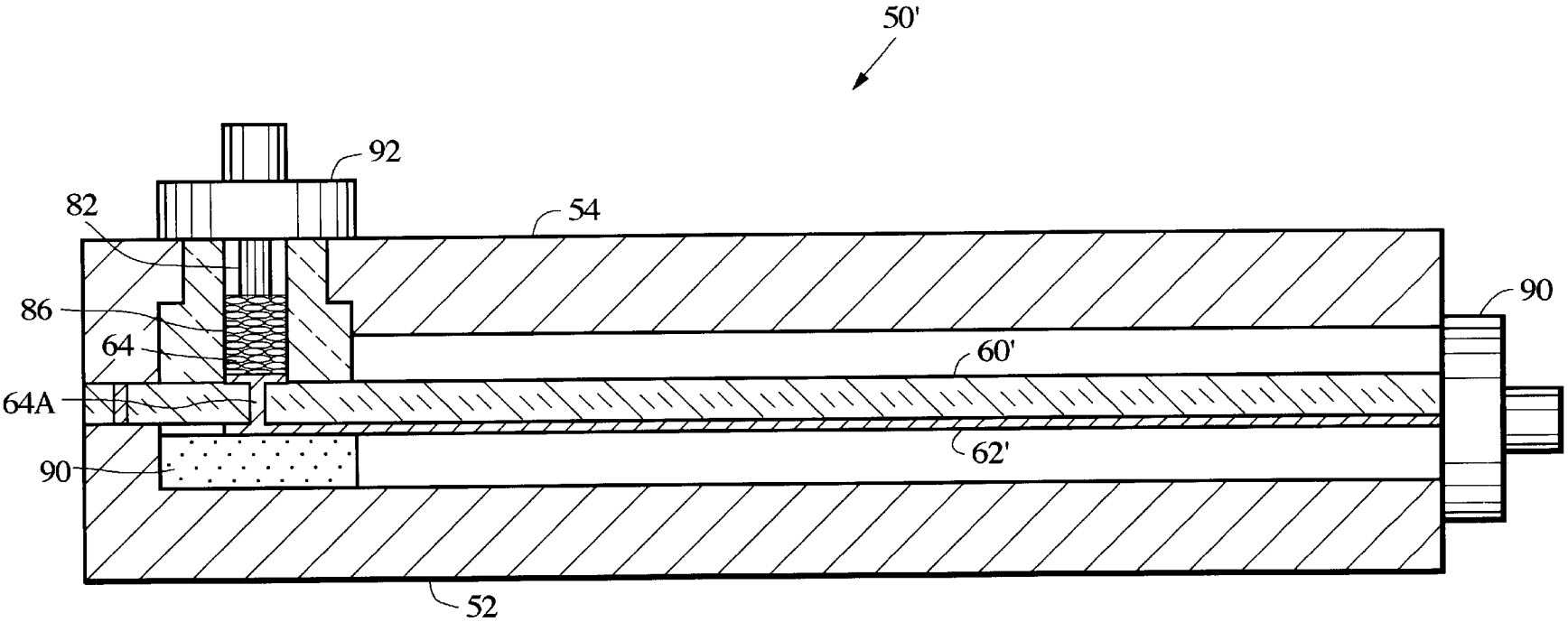
FIG. 2 is an unscaled side cross-sectional diagram of a second embodiment of an RF circuit device employing an airline-to-coaxial interconnect in accordance with the invention.

An alternate embodiment of an RF circuit 50' embodying the invention is illustrated in FIG. 2. This circuit differs from the circuit 50 of FIG. 1 in that the airstrip conductor 62' is disposed on the bottom side of the airline substrate 60' instead of the top side. A conductive pad 64 is formed on the top surface of the substrate 60', and is connected to the airline conductor trace 62' through a plated via hole 64A. A foam block 90 is provided to support the substrate against the compression force exerted by the center pin 82, as in the embodiment of FIG. 1.

Figure 3:
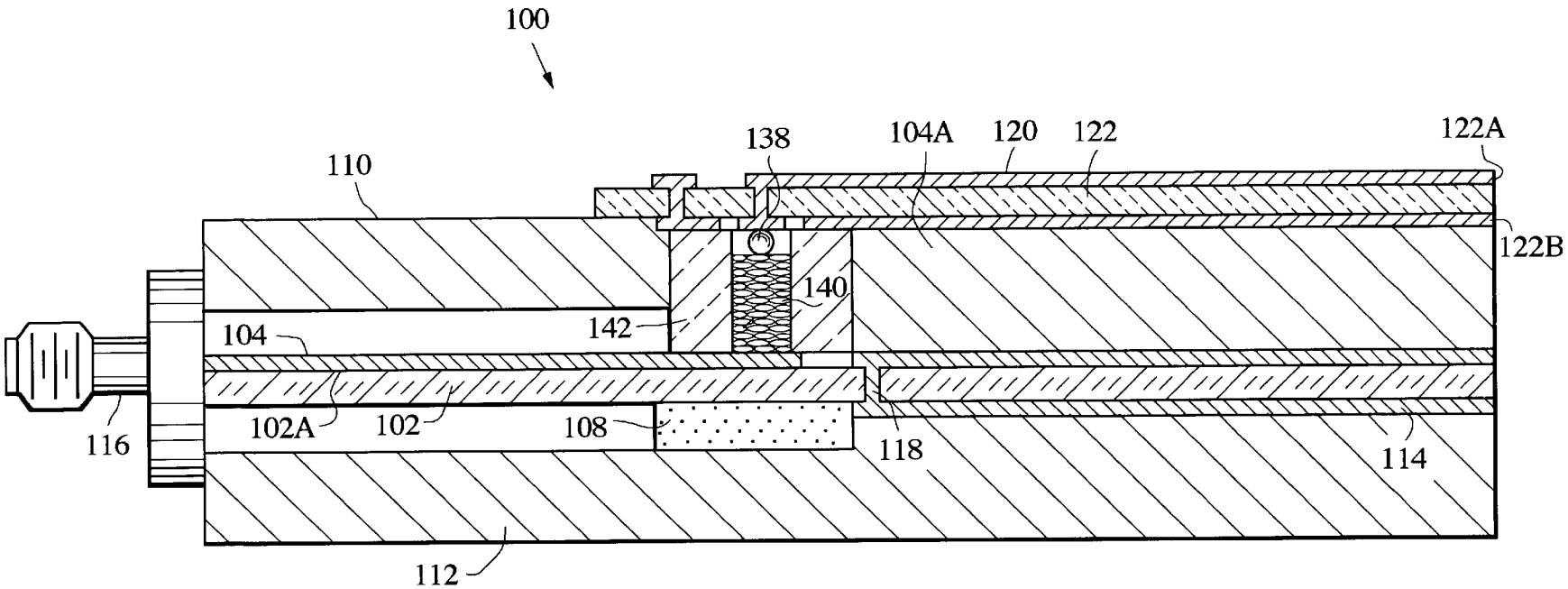
FIG. 3 is an unscaled side cross-sectional diagram of a third embodiment of the invention for an interconnect between an airline and a grounded coplanar waveguide (GCPW) circuit.

The invention can also be used to provide a vertical interconnect between an airline such as suspended substrate stripline (SSS) and a grounded coplanar waveguide (GCPW) circuit. FIG. 3 is a side cross-sectional view illustrative of such an RF interconnect circuit 100. The airline circuit includes a suspended substrate 102 having a top surface 102A and a bottom surface 102B, with a conductor trace 104 formed on the top surface 102A. The circuit 100 includes a conductive housing structure comprising an upper metal plate 110 and a lower metal plate 112. A coaxial connector 116 is attached to the airline conductor 104 and to the housing structure. The bottom surface of the substrate 102 in the airline does not have a conductor trace or conductive layer formed thereon.

Figure 4A:
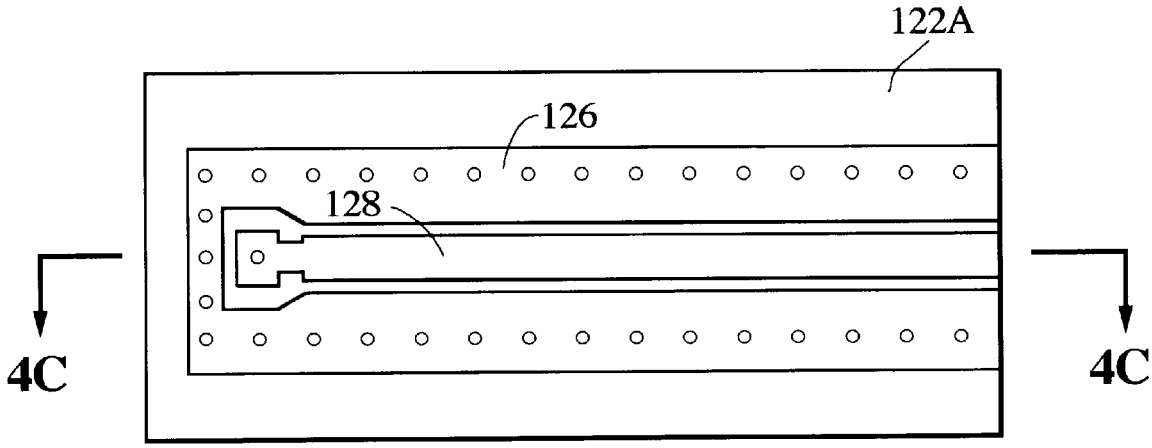
FIG. 4A is an unscaled top view of the GCPW substrate of FIG. 3.
Figure 4B:
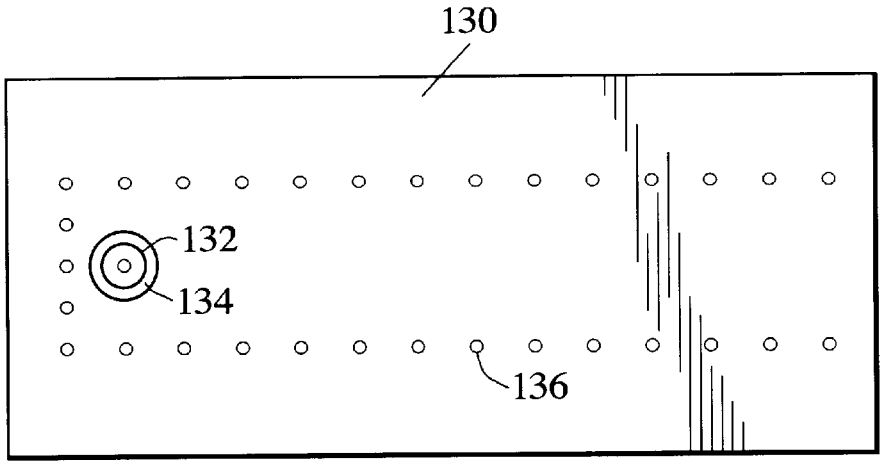
FIG. 4B is an unscaled bottom view of the GCPW substrate.

The GCPW circuit 120 includes a dielectric substrate 122 having conductive patterns formed on both the top surface 122A and the bottom surface 122B. In this exemplary embodiment, the substrate is fabricated of aluminum nitride. The top conductor pattern is shown in FIG. 4A, and includes a conductor center trace 124 and top conductor groundplane 126, the center trace being separated by an open or clearout region 128 free of the conductive layer. The bottom conductor pattern is illustrated in FIG. 4B, and includes the bottom conductor groundplane 130 and circular pad 132, separated by clearout region 134. The top and bottom conductor groundplanes 126 and 130 are electrically connected together by plated through holes or vias 136.

As in the circuits shown in FIGS. 1 and 2, a foam dielectric support 108 is provided below the airline substrate.

Figure 4C:
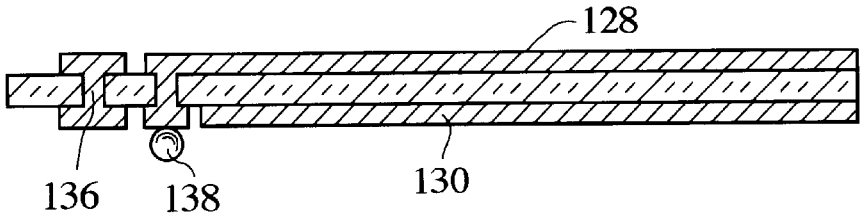
FIG. 4C is an unscaled cross-sectional view taken along line 4C—4C of FIG. 4A.

The GCPW circuit is shown in the isolated cross-section view of FIG. 4C, which also illustrates a metal sphere 138 brazed to the center pad 132 on the bottom of the circuit. In this exemplary embodiment, the sphere is 0.025 inch in diameter. This sphere facilitates the electrical connection to the compressible center interconnect conductor 140 (FIG. 3). A dielectric cylinder 142 captures the compressible center conductor 140. The sphere 138 engages against the top of the compressible conductor 140, and provides compression force on the center conductor 140, to compress the conductor against the airline center conductor 104.

The substrate 102 extends below the GCPW circuit, separated by the top housing plate region 104A. A bottom conductor layer 114 is formed on the substrate 102 in this region, and the substrate has plated through holes 118 formed therein to make electrical contact with the housing plate region 104A, thereby providing common grounding between the airline circuit and the GCPW circuit.

Figure 5:
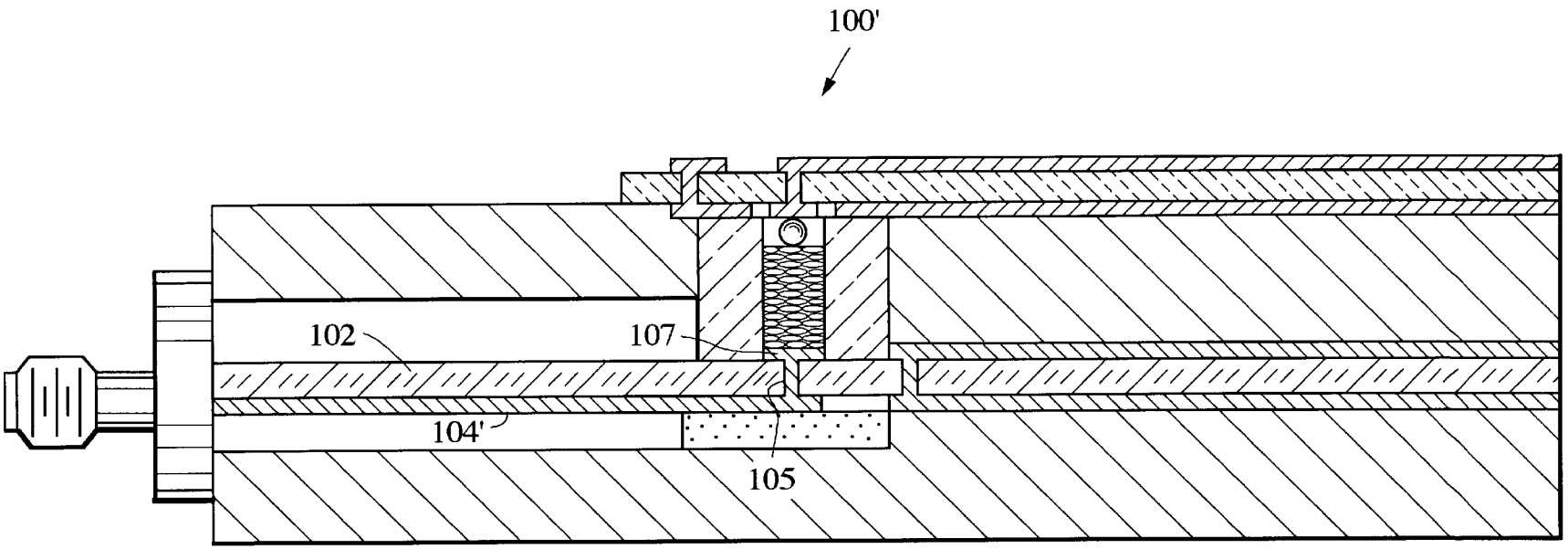
FIG. 5 is an unscaled side cross-sectional diagram of a fourth embodiment of the RF interconnect between an airline and a grounded coplanar waveguide (GCPW) circuit.

An alternate embodiment of the airline to CGPW circuit interconnect is show in FIG. 5. This embodiment has the airline conductor trace 104' formed on the bottom side of the airline substrate 102', with a plated through hole 105 extending through the substrate to a circular conductive pad 107 formed on the upper surface of the substrate.

Figure 6C:
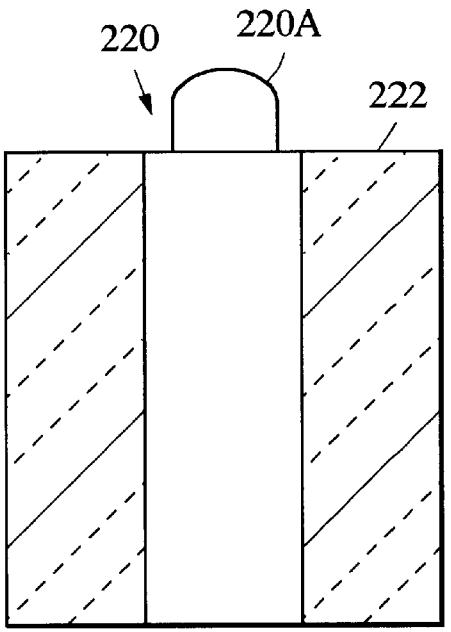
FIGS. 6A–6C illustrate three embodiments of the compressible conductor structure of an RF interconnect in accordance with the invention.
Figure 6B:
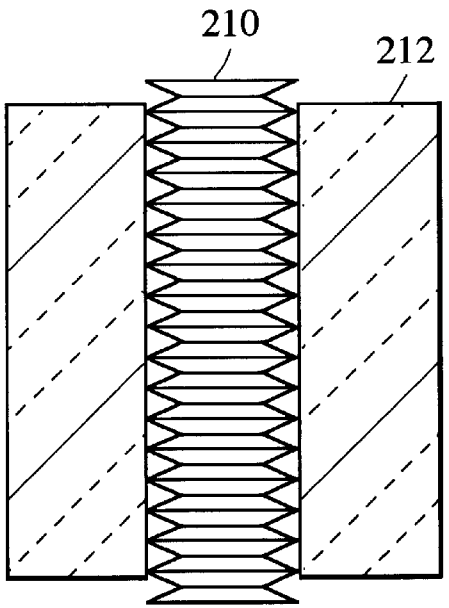
Figure 6A:
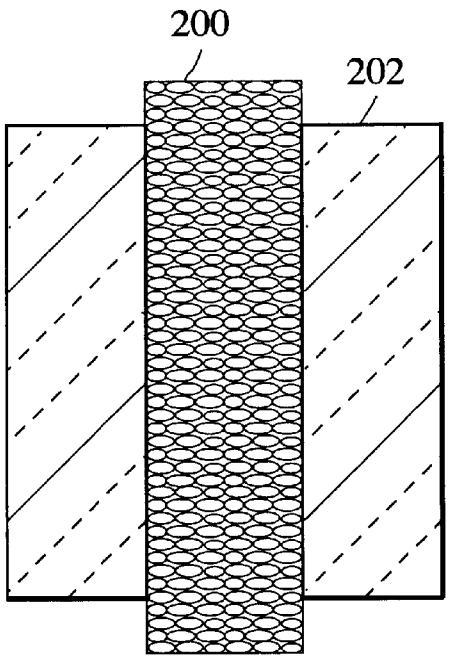

Three alternate types of compressible center conductors suitable for use in interconnect circuits embodying the invention are shown in FIGS. 6A–6C. FIG. 6A shows a compressible wire bundle 200 in a dielectric sleeve 202, and is the embodiment of compressible center conductor illustrated in the embodiments of FIGS. 1–4. FIG. 6B shows an electroformed bellow structure 210 in a dielectric sleeve 212; the bellows is compressible. FIG. 6C shows a "pogo pin" spring loaded structure 220 in a dielectric sleeve 222; the tip 220A is spring-biased to the extended position shown, but will retract under compressive force.

A vertical interconnect in accordance with the invention provides good, robust RF connections and provides a viable alternative to soldered hard pins, or pin/socket interconnects. The compressibility of the center conductor allows for blindmate, vertical interconnects onto suspended stripline while maintaining a good, wideband RF connection. The compressible center conductor also maintains a good physical contact without the use of solder or conductive epoxies. This new RF interconnect can be applied to both sides of the circuit board.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An RF interconnect between an airline circuit including a dielectric substrate having a conductor trace formed on a first substrate surface and an RF circuit vertically separated from the airline circuit by a separation distance, the RF interconnect comprising:

a compressible conductor structure having an uncompressed length exceeding the separation distance;

a dielectric sleeve structure surrounding at least a portion of the uncompressed length of the compressible conductor structure;

and wherein said RF interconnect structure is disposed between said substrate and said RF circuit such that said compressible conductor is placed under compression between said substrate and said RF circuit, and and wherein said RF interconnect structure is disposed between said substrate and said RF circuit such that said compressible conductor is placed under compression between said substrate and said RF circuit, and wherein said RF circuit is a grounded coplanar waveguide (GCPW) circuit including a GCPW dielectric substrate with a first surface having a conductor center trace and a ground conductor pattern formed thereon, said compressible conductor under compression between said GCPW substrate and said airline substrate.

2. The RF interconnect of claim 1 wherein said RF circuit is a coaxial transmission line including a coaxial center conductor, said center conductor extending transverse to an airline substrate, said compressible conductor under compression between said coaxial center conductor and said substrate.

3. The RF interconnect of claim 1 wherein said first substrate surface faces the RF circuit, and an end of said compressible conductor is in contact with said airline conductor trace.

4. The RF interconnect of claim 1 wherein said first substrate surface faces away from the RF circuit, the substrate including a second substrate surface which faces the RF circuit, the substrate further including a conductive pad on the second substrate surface and a conductive via extending through the substrate between the airline conductor trace and the conductive pad, and wherein an end of said compressible conductor is in contact with said conductive pad.

5. The RF interconnect of claim 1 wherein said GCPW substrate is parallel to the airline substrate.

6. The RF interconnect of claim 1 wherein a first end of the compressible conductor structure is in contact with said RF circuit at a first contact area, a second end of the compressible conductor structure is in contact with the airline circuit at a second contact area, and wherein the first and second contact areas are free of any permanent solder or epoxy material.

7. The RF interconnect of claim 1 wherein the compressible conductor structure includes a densely packed bundle of thin conductive wire.

8. The RF interconnect of claim 1 wherein the compressible conductor structure includes a compressible bellows structure.

9. The RF interconnect of claim 1 wherein the compressible conductor structure includes a spring-loaded retractable probe structure.

10. The RF interconnect of claim 1 further comprising a dielectric support block disposed between the airline substrate and a housing structure to support the dielectric substrate against compression forces exerted by the compressible center conductor on the substrate.

11. A method of forming an RF interconnect between an airline circuit including a dielectric substrate having a conductor trace formed on a first substrate surface and an RF circuit vertically separated from the airline circuit by a separation distance, the method comprising:

providing a compressible conductor structure having an uncompressed length exceeding the separation distance, the compressible conductor structure in a dielectric sleeve structure surrounding at least a portion of the uncompressed length of the compressible conductor structure; and placing the RF interconnect structure between said substrate and said RF circuit such that the compressible conductor is placed under compression between the substrate and the RF circuit;

wherein the RF circuit is a grounded coplanar waveguide (GCPW) circuit including a GCPW dielectric substrate with a first surface having a conductor center trace and a ground conductor pattern formed thereon, and wherein after said placing, the compressible conductor is under compression between the GCPW substrate and the airline substrate.

12. The method of claim 11 wherein the RF circuit is a coaxial transmission line including a coaxial center conductor, and wherein the placing of the RF interconnect structure results in the compressible conductor structure extending transverse to the airline substrate, the compressible conductor under compression between the coaxial center conductor and the substrate.

13. The method of claim 11 wherein said first substrate surface faces the RF circuit after the placing of the RF interconnect structure, and an end of the compressible conductor is in contact with the airline conductor trace.

14. The method of claim 11 wherein the first substrate surface faces away from the RF circuit after the placing of the RF interconnect structure, the substrate including a second substrate surface which faces the RF circuit, the substrate further including a conductive pad on the second substrate surface and a conductive via extending through the substrate between the airline conductor trace and the conductive pad, and wherein an end of said compressible conductor is in contact with said conductive pad.

15. The method of claim 11 wherein the GCPW substrate is parallel to the airline substrate after said placing of the RF interconnect structure.

16. The method of claim 11 wherein a first end of the compressible conductor structure is in contact with said RF circuit at a first contact area after said placing, a second end of the compressible conductor structure is in contact with the airline circuit at a second contact area after said placing, and wherein the first and second contact areas are free of any permanent solder or epoxy material.

17. An RF interconnect between an airline circuit including a dielectric substrate having a conductor trace formed on a first substrate surface and an RF circuit vertically separated from the airline circuit by a separation distance, the RF interconnect comprising:

a compressible conductor structure having an uncompressed length exceeding the separation distance;

a dielectric sleeve structure surrounding at least a portion of the uncompressed length of the compressible conductor structure;

and wherein said RF interconnect structure is disposed between said substrate and said RF circuit such that said compressible conductor is placed under compression between said substrate and said RF circuit, and wherein a first end of the compressible conductor structure is in contact with said RF circuit at a first contact area, a second end of the compressible conductor structure is in contact with the airline circuit at a second contact area, and wherein the first and second contact areas are free of any permanent solder or epoxy material.

18. The RF interconnect of claim 17 wherein said RF circuit is a coaxial transmission line including a coaxial center conductor, said center conductor extending transverse to an airline substrate, said compressible conductor under compression between said coaxial center conductor and said substrate.

19. The RF interconnect of claim 17 wherein said first substrate surface faces the RF circuit, and an end of said compressible conductor is in contact with said airline conductor trace.

20. The RF interconnect of claim 17 wherein said first substrate surface faces away from the RF circuit, the substrate including a second substrate surface which faces the RF circuit, the substrate further including a conductive pad on the second substrate surface and a conductive via extending through the substrate between the airline conductor trace and the conductive pad, and wherein an end of said compressible conductor is in contact with said conductive pad.

21. The RF interconnect of claim 17 wherein the compressible conductor structure includes a densely packed bundle of thin conductive wire.

22. The RF interconnect of claim 17 wherein the compressible conductor structure includes a compressible bellows structure.

23. The RF interconnect of claim 17 wherein the compressible conductor structure includes a spring-loaded retractable probe structure.

24. An RF interconnect between an airline circuit including a dielectric substrate having a conductor trace formed on a first substrate surface and an RF circuit vertically separated from the airline circuit by a separation distance, the RF interconnect comprising:

a compressible conductor structure having an uncompressed length exceeding the separation distance;

a dielectric sleeve structure surrounding at least a portion of the uncompressed length of the compressible conductor structure;

a dielectric support block disposed between the airline substrate and a housing structure to support the dielectric substrate against compression forces exerted by the compressible center conductor on the substrate;

and wherein said RF interconnect structure is disposed between said substrate and said RF circuit such that said compressible conductor is placed under compression between said substrate and said RF circuit.

25. The RF interconnect of claim 24 wherein said RF circuit is a coaxial transmission line including a coaxial center conductor, said center conductor extending transverse to an airline substrate, said compressible conductor under compression between said coaxial center conductor and said substrate.

26. The RF interconnect of claim 24 wherein said first substrate surface faces the RF circuit, and an end of said compressible conductor is in contact with said airline conductor trace.

27. The RF interconnect of claim 24 wherein said first substrate surface faces away from the RF circuit, the substrate including a second substrate surface which faces the RF circuit, the substrate further including a conductive pad on the second substrate surface and a conductive via extending through the substrate between the airline conductor trace and the conductive pad, and wherein an end of said compressible conductor is in contact with said conductive pad.

28. The RF interconnect of claim 24 wherein the compressible conductor structure includes a densely packed bundle of thin conductive wire.

29. The RF interconnect of claim 24 wherein the compressible conductor structure includes a compressible bellows structure.

30. The RF interconnect of claim 24 wherein the compressible conductor structure includes a spring-loaded retractable probe structure.

31. A method for forming an RF interconnect between an airline circuit including a dielectric substrate having a conductor trace formed on a first substrate surface an RF circuit vertically separated from the airline circuit by a separation distance, the method comprising:

providing a compressible conductor structure having an uncompressed length exceeding the separation distance, the compressible conductor structure in a dielectric sleeve structure surrounding at least a portion of the uncompressed length of the compressible conductor structure; and placing the RF interconnect structure between said substrate and said RF circuit such that the compressible conductor is placed under compression between the substrate and the RF circuit;

wherein a first end of the compressible conductor structure is in contact with said RF circuit at a first contact area after said placing, a second end of the compressible conductor structure is in contact with the airline circuit at a second contact area after said placing, and wherein the first and second contact areas are free of any permanent solder or epoxy material.

32. The method of claim 31 wherein the RF circuit is a coaxial transmission line including a coaxial center conductor, and wherein the placing of the RF interconnect structure results in the compressible conductor structure extending transverse to the airline substrate, the compressible conductor under compression between the coaxial center conductor and the substrate.

33. The method of claim 31 wherein said first substrate surface faces the RF circuit after the placing of the RF interconnect structure, and an end of the compressible conductor is in contact with the airline conductor trace.

34. The method of claim 31 wherein the first substrate surface faces away from the RF circuit after the placing of the RF interconnect structure, the substrate including a second substrate surface which faces the RF circuit, the substrate further including a conductive pad on the second substrate surface and a conductive via extending through the substrate between the airline conductor trace and the conductive pad, and wherein an end of said compressible conductor is in contact with said conductive pad.

* * * * *